US006233203B1

(12) United States Patent
Kawata

(10) Patent No.: US 6,233,203 B1
(45) Date of Patent: May 15, 2001

(54) ELECTRONIC TIMEPIECE

(75) Inventor: Masayuki Kawata, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/349,856

(22) Filed: Jul. 8, 1999

(30) Foreign Application Priority Data

Jul. 19, 1998 (JP) ..... 10-194172

(51) Int. Cl.[7] ..... G04B 47/00; G04B 37/00; A44C 5/00

(52) U.S. Cl. ..... 368/10; 368/276; 368/281

(58) Field of Search ..... 368/10, 11, 88, 368/276, 278, 281, 282, 203–204

(56) References Cited

U.S. PATENT DOCUMENTS 5,781,511 * 7/1998 Yasukawa et al. ..... 368/11

FOREIGN PATENT DOCUMENTS 1518954 7/1978 (GB) .
2159304 11/1985 (GB) .
2241092 6/1991 (GB) .

* cited by examiner

*Primary Examiner*—Vit Miska
(74) *Attorney, Agent, or Firm*—Adams & Wilks

(57) ABSTRACT

A battery accommodation section is made attachable to and detachable from a lower portion of a timepiece main body thereby electrically connecting between the timepiece main body and the battery accommodation section through a connector section. A timepiece main body side terminal is connected to a timepiece module, while the battery accommodation section side terminal is connected to a primary battery. In the state that the battery accommodation section is provided with the timepiece main body, the primary battery and the timepiece module are brought into electrical connection through the connector section whereby electric power can be supplied from the primary battery to the timepiece module. In this manner, if the timepiece main body is mounted on the upper portion of the battery accommodation section, appearance is good and fixing on the arm is easy.

22 Claims, 11 Drawing Sheets

B - B'

C - C'

ELECTRONIC TIMEPIECE

BACKGROUND OF THE INVENTION

1. Field of the Invention

This invention relates to electronic timepieces, and more particularly to an electronic timepiece which can fulfill such conditions that are good in appearance, easy to fix on an arm, suppressed in the number of parts and easy to be mounted with a large-sized power source, etc.

2. Description of the Prior Art

Recently, there is a tendency toward increase in electric timepiece power consumption as the electronic timepiece becomes multi-functioned. For example, power consumption is considerably increased for those electronic timepieces provided with personal computer functions and those with television functions. Accordingly they require a large-sized power source suited for them. On the other hand, watches are usually worn on an arm during walking. Accordingly, they will be poor in appearance and obstructive if they made large, and tiring if become heavy. Meanwhile, the frequent replacement of a small capacity battery requires opening of the battery lid in each time, hence resulting in troublesomeness. For these reasons, a variety of devising are required for timepiece power sources. For example, JP-A-56-94982U discloses a technology concerning a battery accommodation structure for an electronic timepiece.

FIG. 10 is an explanatory view showing one example of the above-described electronic timepiece. FIG. 11 is a sectional view showing the timepiece 200 shown in FIG. 10. A battery accommodation section 203 is provided between a watch strap 202 and a main body case 201. As for this battery 204, the battery accommodation section 203 is connected to a positive terminal 206 and a negative terminal 205. The positive terminal 206 and the negative terminal 205 are connected with a copper wire 207. Also, insulation elastic members 208 are provided bridging over between the main body case 201 and the battery accommodation section 203. The insulation elastic member 208 is a cylindrical member having a coiled spring 209 arranged therein. The insulation elastic member 208 is attached at respective ends with pin terminals 210, and the opposite pin terminals are electrically connected by the coiled spring 209 to each other. One of the pin terminals 210 is connected to the copper wire 207 extended from the positive terminal 206 and the negative terminal 205 of the battery. The other of the pin terminals 210 extends to an inside of the main body case 201. The battery accommodation section 203 is fixed to the main body case 201 with screws 211, for attachment and detachment. In this manner, the timepiece can be reduced in thickness by taking the battery 204 from the main body case 201 to a side of a strap attaching section side.

However, in the conventional electronic timepiece 200, there has been a problem of poor appearance because the battery accommodation section 203 is provided in a direction of the watch strap 202. Also, the increase in length of the strap attaching section causes disagreement with the radius of curvature of an arm resulting in a problem of difficulty in closely fitting and fixing on the arm. It is Impossible to closely fit this structure on the arm even in a case that the battery accommodation section 203 is attached obliquely relative to the main body case 201 as shown in FIG. 11. Furthermore, watch straps 202 different in length are required for the case attached with the battery accommodation section 203 and the case without it, causing a problem of increase in the number of parts. Also, the structure made capable of exchanging a large amount of information besides power source supply is favored for the times from now on.

Therefore, the present invention has been made in view of the above, and it is an object to provide an electronic timepiece which satisfies such conditions that are good in appearance, easy to fix on an arm, suppressed in the number of parts and easy to be mounted with a large-sized power source, etc.

SUMMARY OF THE INVENTION

In order to achieve the above-stated object, an electronic timepiece according to the present invention comprises: a main body case internally provided with a main function realizing means for timepiece movement and others functions and having a first connector electrically connected to these main function realizing means; and a separate case provided attachably to and detachably from a lower portion of the main body case, and having a second connector connected to the first connector in a state attached to the main body case and a sub-function realizing means to be electrically connected to this second connector.

By attaching the separate case to the main body case, if the first connector and the second connector are coupled, the sub-function realizing means extends the functions of the timepiece. The sub-function realizing means may include such functions as a computer. The operation results obtained by the computer are displayed on a display section of the main body case through the connector. Also, because the separate case is attached to the lower portion of the main body case instead of on the watch strap side, the timepiece is easy to fix on the arm and good in appearance. Furthermore, because the separate case can be attached as required, the function of the timepiece can be easily extended.

Also, an electronic timepiece of another structure according to the present invention comprises: a main body case internally provided with a first power source provided to supply power to a main function realizing means for timepiece movement and other functions and having a first connector to be electrically connected to the main function realizing means; and a separate case provided attachably to and detachably from a lower portion of the main body case, and having a second connector connected to the first connector in a state attached to the main body case and a second power source to be electrically connected to this second connector.

If the separate case is attached to the lower portion of the main body case, the second connector and the first connector are coupled thereby enabling power supply from the second power source to the main function realizing means. By doing so, even where the main function realizing means is high in power consumption, sufficient electric power can be supplied. Also, because the separate case is attached to the lower portion of the main body case instead of on the watch strap side, the timepiece is easy to fix on the arm and good in appearance. Furthermore, because the separate case can be attached as required, the function of the timepiece can be easily extended.

Also, an electronic timepiece of another structure according to the present invention is provided with: a main body case having an electronic circuit of a timepiece module and other functions a first power source for supplying power to this electronic circuit, and a first connector connected to this first power source; and a separate case having a second power source accommodated therein, a second connector connected to a second power source incorporated, and an attachment/detachment structure for the main body case provided at an upper portion; wherein the first connector and the second connector are coupled in a state that the main body case and the separate case are attached, thereby electrically connecting the first power source and the second power source.

If the main body case and separate case are attached, the first connector and the second connector are coupled, the first power source and the second power source are put into electrical connection. For example, where the second power source is a primary battery and the first power source is a secondary battery, it becomes possible to charge the secondary battery on the main body case side. Therefore, electric power can be supplied when required. Also, it is possible to save time and labor for exchanging the battery on the main body case side. Also, where both are secondary batteries, electric charge is possible by utilizing the second connector on the separate case side. In this case, there is no necessity for both batteries to be replaced.

Meanwhile, the main body case is arranged to be attached to an upper portion of the separate case, the timepiece Is easy to fix on the arm and good in appearance. Furthermore, if the separate case is arranged to be removed as required, the timepiece is improved in portability. Also, where the both are primary batteries, connection in series provides greater electric power while parallel connection increases the time period for supplying power.

Also, another electronic timepiece according to the present invention, in the above electronic timepiece, attaching portions are further provided for attaching the same watch straps to both ends of the main body case and both ends of the separate case.

The separate case is attached to the lower portion of the main body case, and therefore the watch straps of almost same length are satisfactory. Due to this, the same watch straps can be commonly used for the main body case and the separate case by providing the same attaching portions on the main body case and the separate case.

BRIEF DESCRIPTION OF THE DRAWINGS

A preferred form of the present invention is illustrated in the accompanying drawings in which.

DETAILED DESCRIPTION OF THE PREFERRED EMBODIMENTS

Hereinunder, this invention will be explained in detail with reference to the drawings. Incidentally, this invention is not limited by this embodiment.

Figure 1:
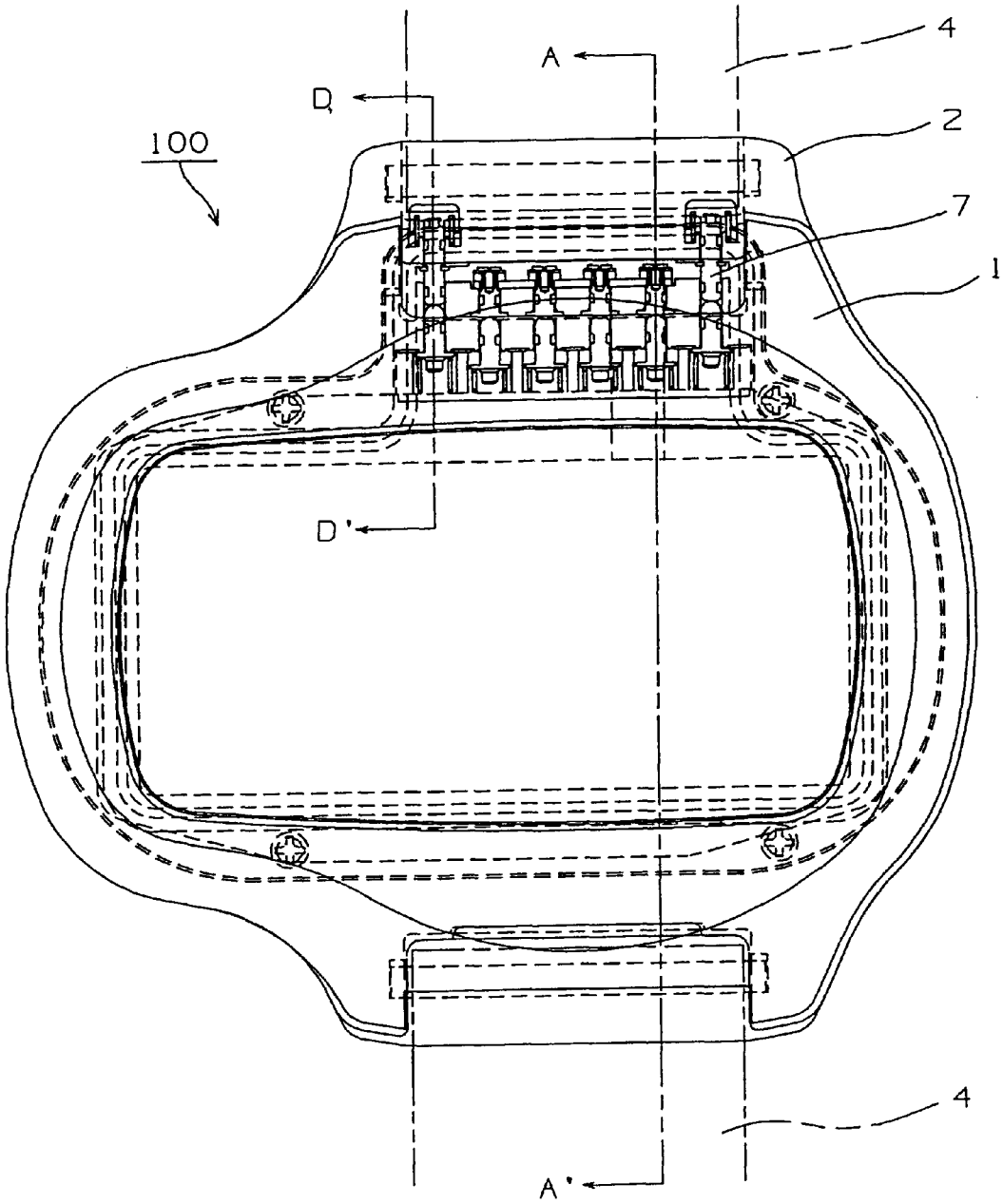
FIG. 1 is a front view showing an electronic timepiece according to Embodiment 1 of this invention.
Figure 2:
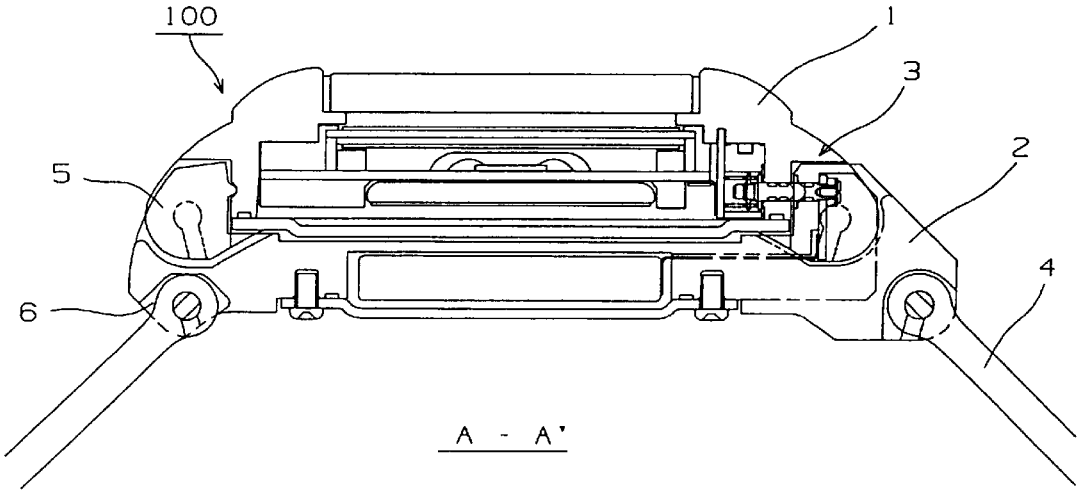
FIG. 2 is a sectional view showing the electronic timepiece shown in FIG. 1.

FIG. 1 is a front view showing an electronic timepiece according to Embodiment 1 of this invention. FIG. 2 is a sectional view of the electronic timepiece shown in FIG. 1. This electronic timepiece 100 is a split structure having a time piece main body 1 and a battery accommodation section 2. The timepiece main body 1 and the battery accommodation section 2 are electrically connected by a connector section 3. The detailed structure of the connector section 3 will be described later. The timepiece main body 1 and the battery accommodation section 2 are respectively provided with watch strap attaching portions 5, 6 for attaching the same watch straps 4. Also, the connector section 3 has fixing structures 7 at both sides. The detail of the fixing structure 7 will be described later. When the battery accommodation section 2 is mounted on the timepiece main body 1, the watch strap 4 is attached to the battery accommodation section 2. When only the timepiece main body 1 is used, the watch strap 4 is attached to the timepiece main body 1.

Figure 3:
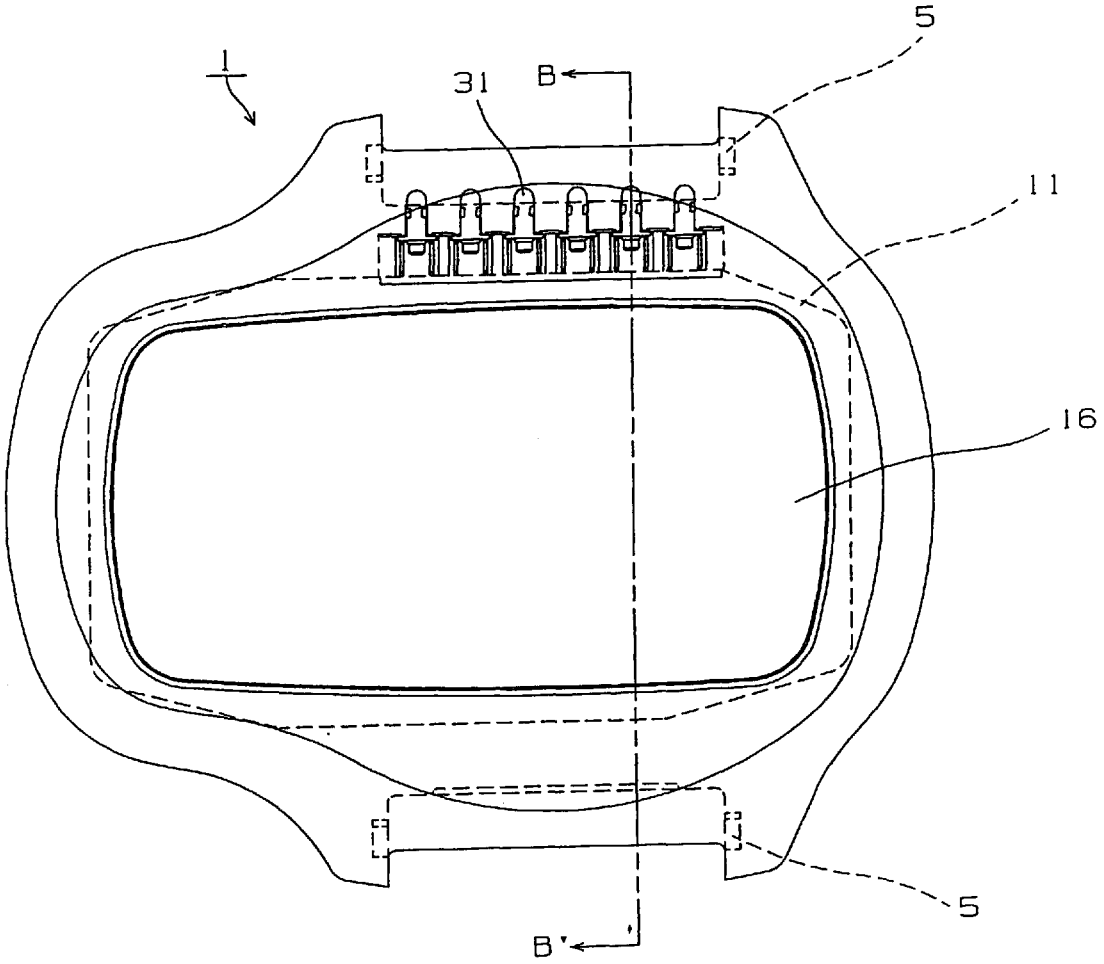
FIG. 3 is a front view showing a timepiece main body shown in FIG. 1.
Figure 4:
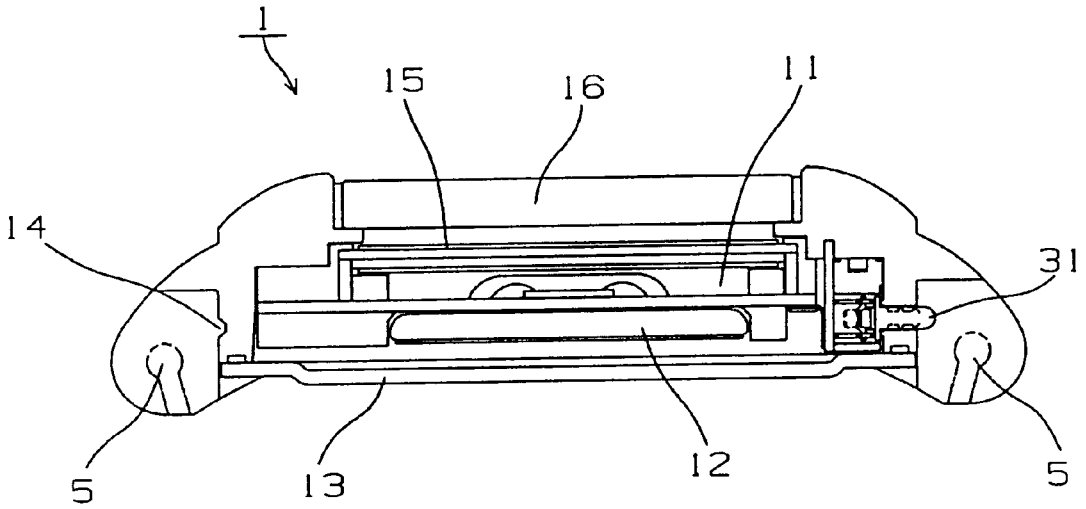
FIG. 4 is a sectional view showing the electronic timepiece main body.

FIG. 3 is a front view showing a timepiece main body shown in FIG. 1. FIG. 4 is a sectional view of the timepiece main body. The timepiece main body 1 accommodates therein a timepiece module 11 and a main battery 12 to supply power to the timepiece module 11 (main function realizing means). The main battery 12 is a secondary battery and is exchangeable by removing a back lid 13. Also, the timepiece module 11 is electrically connected to a timepiece main body side terminal 31 (not shown) of the connector section 3. A glass 16 is fitted at the front of the timepiece main body under which a liquid crystal panel 15 is arranged. A fixing recess 14 is provided on a side opposite to the connector section 3 of the timepiece main body 1. At the front of the timepiece module 11, the liquid crystal panel 15 and the glass 16 are arranged.

Figure 5:
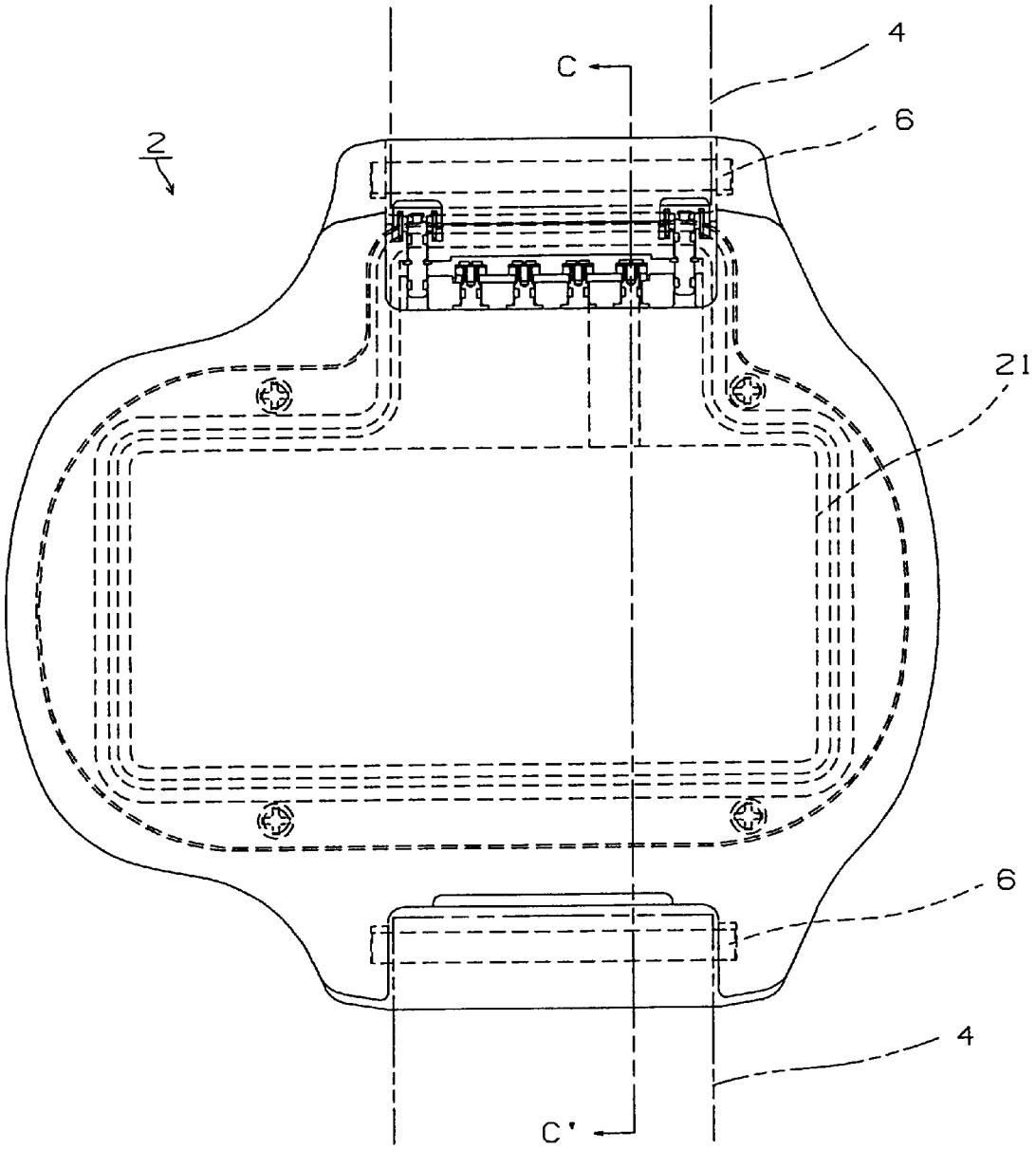
FIG. 5 is a front view showing a battery accommodation section shown in FIG. 1.
Figure 6:
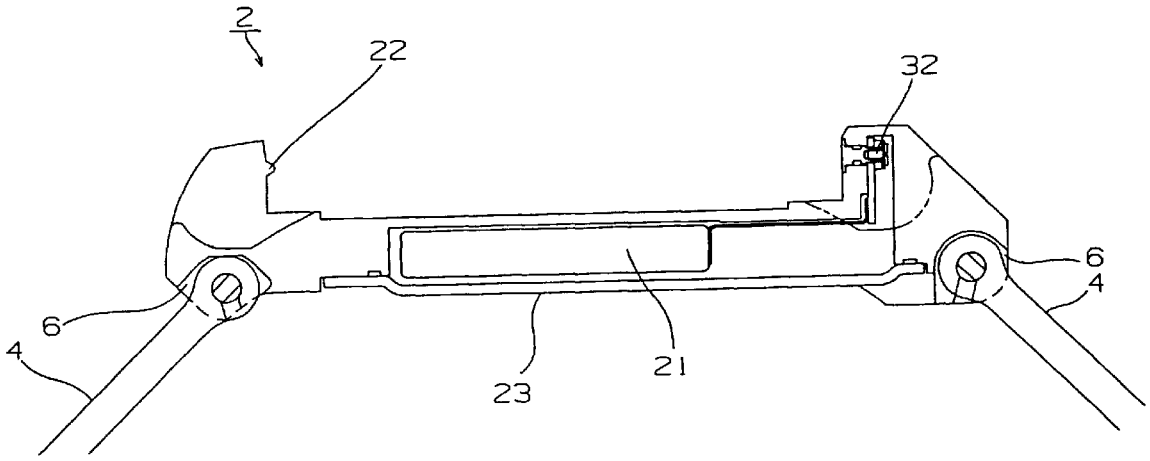
FIG. 6 is a sectional view of the battery accommodation section.

FIG. 5 is a front view showing the battery accommodation section 2 shown in FIG. 1. FIG. 6 is a sectional view of the battery accommodation section 2. The battery accommodation section 2 accommodates a large capacity primary battery 21 (sub-function realizing means). The primary battery 21 is connected to a battery accommodation section side terminal 32 of the connector section 3. On the opposite side to the connector section 3 is provided a convex portion 22 to be engaged with a concave portion 14. Incidentally, the surface that this convex portion 22 is provided is somewhat slanted in order to attach the timepiece main body 1. Also, the primary battery 21 is exchangeable by removing a separate case back lid 23. In the same figure, a state is shown that the battery accommodation section 2 is attached with the watch strap 4.

Figure 7:
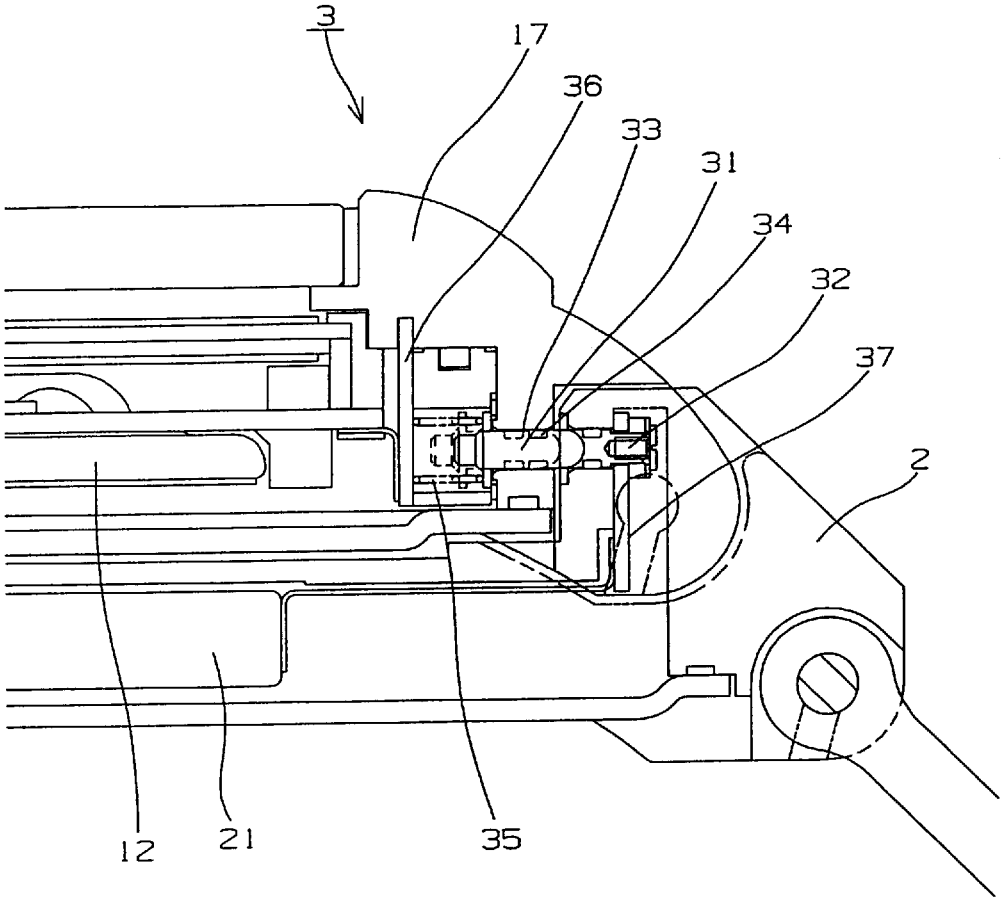
FIG. 7 is a sectional view showing a structure of a connector section shown in FIG. 1.

FIG. 7 is a sectional view showing a structure of the connector section 3 shown in FIG. 1. The timepiece main body side terminal 31 moves along a terminal slide hole 33 provided in a case 17 for the timepiece main body 1.

Also, a ring groove 34 of the timepiece main body side terminal 31 is provided with a packing (not shown). The timepiece main body side terminal 31 is outwardly urged by a spring 35. A seat of the spring 35 is fixed on a main case side conduction substrate 36, and this main body case side conduction substrate 36 is electrically connected to the main battery 12. The battery accommodation section side terminal 32 is fixed at an opposite position to the timepiece main body side terminal 31, and screwed, at the inner side of the battery accommodation section 2, to the separate case side conduction substrate 37. The separate case side conduction substrate 37 is electrically connected to the primary battery 21.

Figure 8:
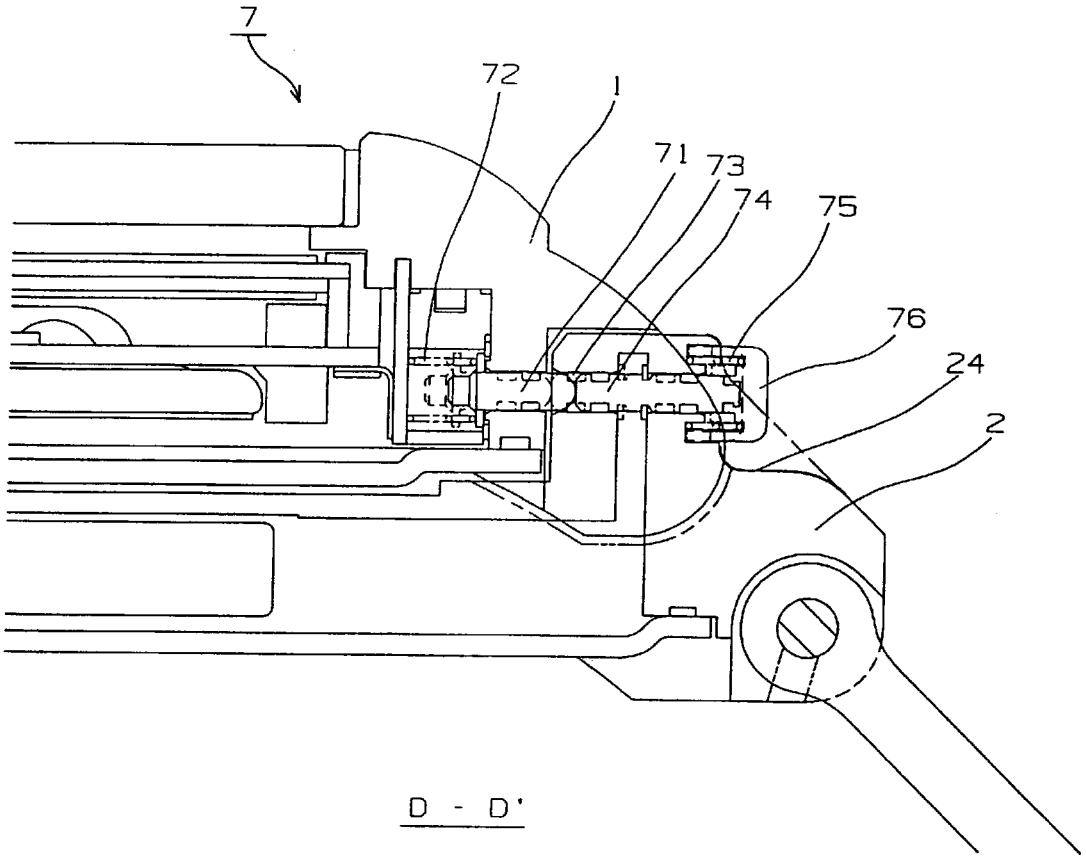
FIG. 8 is a sectional view showing a fixing structure for the timepiece main body and the battery accommodation section.

FIG. 8 is a sectional view showing a fixing structure of the timepiece main body 1 to the battery accommodation section 2 (section D–D' in FIG. 1). This fixing structure 7 is provided in parallel with the above connector section 3. On a timepiece main body 1 side, a fixing pin 71 is provided. The fixing pin 71 is outwardly urged by a fixing pin spring 72. A fixing hole 73 in which the fixing pin 71 is to be fitted is provided on a battery accommodation section 2 side. The fixing hole 73 is provided with a separation pin 74 for removing the fixing pin 71. The separation pin 74 is urged outward by a spring 75, and fixed at its end with a separation button 76. The separation button 76 projects from a case 24 for the battery accommodation section 2. A fixed state is shown by the solid line. Upon removal, the separation button 76 is depressed to press in the fixing pin 71 by the separation pin 74. In this state (shown by the dotted line) the timepiece main body 1 can be removed.

Figure 9:
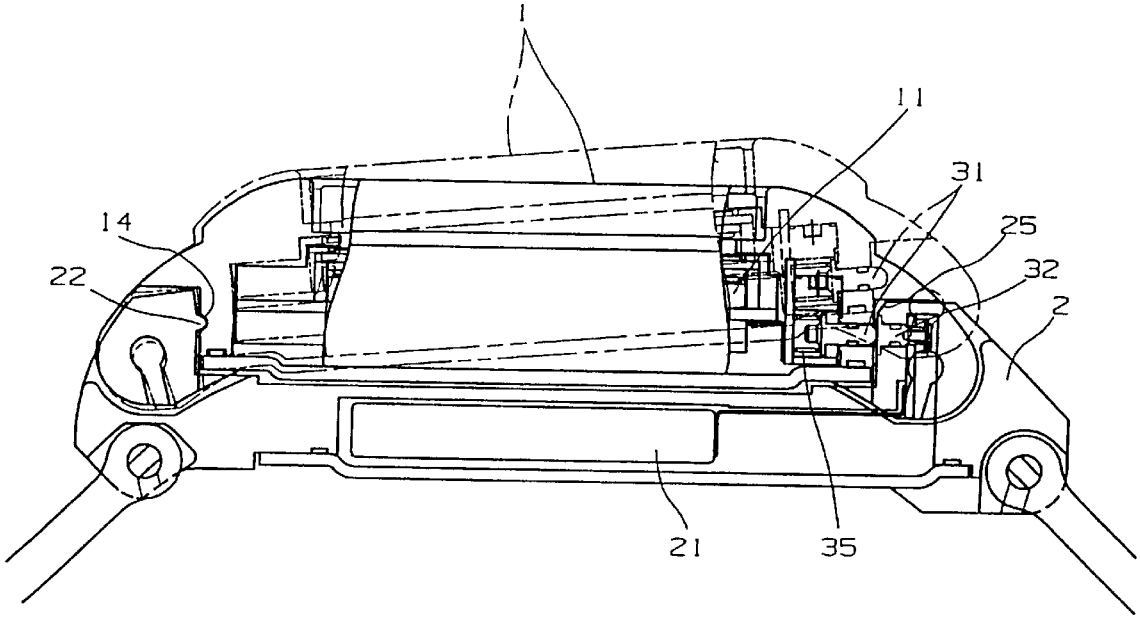
FIG. 9 is an explanatory view showing a state that the battery accommodation section is being attached to the timepiece main body.
Figure 10:
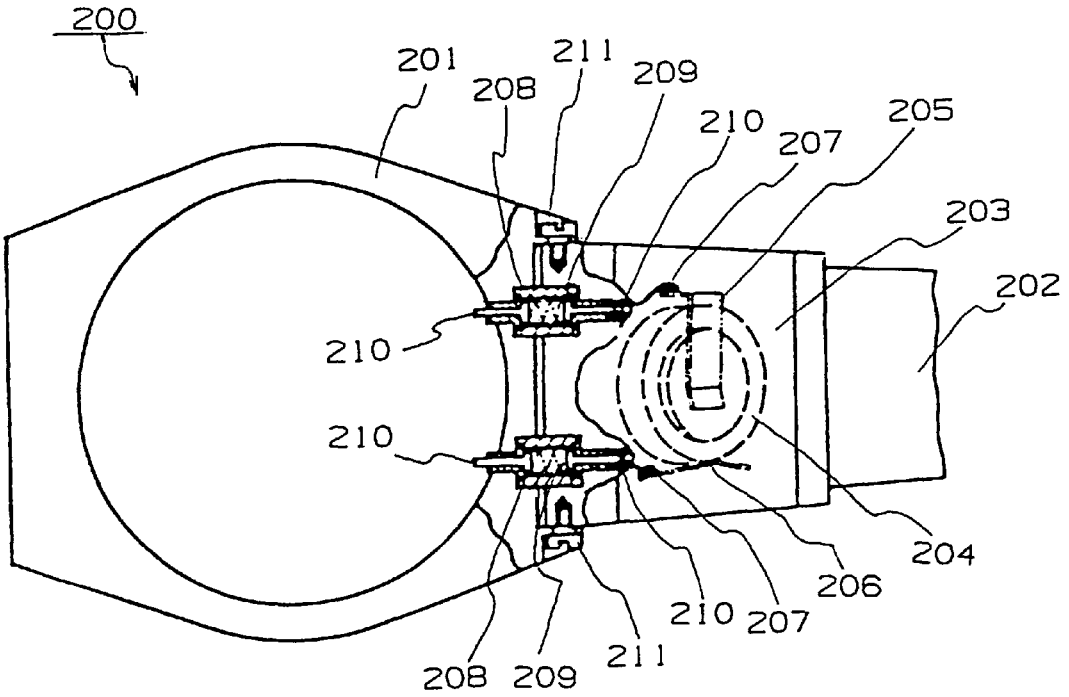
Fig.10 prior art
FIG. 10 is an explanatory view showing one example of a conventional electronic timepiece.
Figure 11:
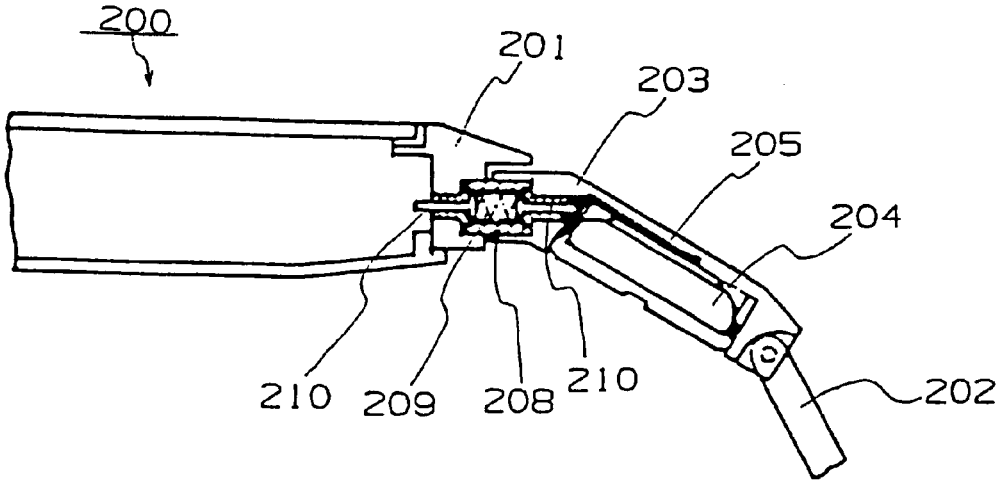
Fig.11 prior art
FIG. 11 is a sectional view showing the timepiece shown in FIG. 10.

FIG. 9 is an explanatory view showing a state that the battery accommodation section 2 is being mounted to the timepiece main body 1. First, the timepiece main body 1 is obliquely inserted relative to the battery accommodation section 2. At this time, the convex portion 22 of the battery accommodation section 2 is fitted in the concave portion 14 of the timepiece main body 1. On the other hand, the timepiece main body side terminal 31, although projecting from the timepiece main body 1 due to the urging force of the spring 35, is brought into contact with a cut-out 25 of the battery accommodation section 2 and pressed inward. In a state that the timepiece main body 1 is completely mounted on the battery accommodation section 2, the timepiece main body side terminal 31 and the battery accommodation section side terminal 32 come into contact. The timepiece main body 1 is fixed by the fixing structure 7. Due to this, electrical connection is made between the primary battery of the battery accommodation section 2 and the timepiece module 11 of the timepiece main body 1.

Incidentally, when removing the timepiece main body 1, it is separated while depressing the separation button 76.

In addition, although in the above embodiment connection was made between the primary battery 21 and the timepiece module 11, those to be connected are not limited to this. For example, a computer or a large capacity memory may be incorporated as a sub-function realizing means on the battery accommodation section 2 side to extend the function of the timepiece main body 1. On the timepiece main body 1 side, besides the timepiece module 11 an electronic appliance requiring large power, such as a computer, may be mounted as a main function realizing means. In this case, this electronic appliance can be supplied with power by supplying power from the battery accommodation section 2 side. Further, information exchange can be made through the connector section 3. For example, a computer (main function realizing means) is incorporated on the timepiece main body 1 side, a software-memorized memory (sub function realizing means) is incorporated on the battery accommodation section 2 side, and information exchange is made through the connector section 3.

Next, primary batteries may be used for both the timepiece main body 1 side and the battery accommodation section 2 side. In this case, the timepiece main body side terminal 31 and the battery accommodation section side terminal 32 are connected to respective batteries. In this structure, where the timepiece main body 1 side and the battery accommodation section 2 side are connected in series, a large voltage is obtained. Accordingly, it is possible to cope with an electronic appliance with large power consumption. Also, where the timepiece main body 1 side and the battery accommodation section 2 side are connected in parallel, the electronic appliance can be operated for a long time.

As explained above, according to the electronic timepiece of this invention, the first connector and the second connector are coupled by attaching the separate case to the main body case, thereby connecting the main function realizing means and the sub-function realizing means. By doing so, the timepiece can be easily extended in function. Also, because the separate case is attached not to the watch strap side but to the lower portion of the main body case, the timepiece is easy to fix on the arm and good in appearance.

Also, in the electronic timepiece of this invention, the main function realizing means is supplied with electric power from the second power source by attaching the separate case to the lower portion of the main body case and coupling the second connector with the first connector. Due to this, where the main function realizing means is high in power consumption, sufficient electric power can be supplied. Also, because the separate case is attached to the lower portion of the main body case, the timepiece is easy to fix on the arm and good in appearance.

Further, in the electronic timepiece of this invention, the first power source and the second power source are electrically connected by attaching the main body case and the separate case and coupling the first connector and the second connector. Due to this, electric power can be supplied when required by using the first power source side as a secondary battery, thereby saving the labor for replacing the battery on the main body case side. Also, if the both are primary batteries, large electric power can be supplied by connection in series while electric power supply time can be increased by parallel connection. Furthermore, because the main body case is attached to an upper portion of the separate case, the timepiece is easy to fix on the arm and good in appearance.

Furthermore, because the electronic timepiece of this invention has attaching portions provided at both ends of the main body case and both ends of the separate case to attach the same watch straps, it is possible to use watch straps generally in almost same length, thus reducing the number of parts.

What is claimed is:

1. An electronic timepiece comprising:

a main body case having an upper portion and a lower portion, the lower portion being disposed to face a user's wrist when the timepiece is worn on the user's wrist;

main function realizing means contained in the main body case for performing a main function and including a timepiece movement;

a first connector electrically connected to the main function realizing means;

a separate case detachably mountable to the lower portion of the main body cases;

a second connector connected to the first connector when the separate case is attached to the main body cases; and sub-function realizing means electrically connected to the second connector for performing a function which is not performed by the main function realizing means.

2. An electronic timepiece comprising:

a main body case having an upper portion and a lower portion, the lower portion being disposed to face a user's wrist when the timepiece is worn on the user's wrist;

a first power source contained in the main body case;

main function realizing means for performing a main function and including a timepiece movement driven by the first power source;

a first connector electrically connected to the main function realizing means;

a separate case detachably mountable to the lower portion of the main body case;

a second connector connected to the first connector when the separate case is attached to the main body case; and a second power source electrically connected to the second connector.

3. An electronic timepiece comprising:

a main body case having an upper portion and a lower portion, the lower portion being disposed to at least partially face a user's wrist when the timepiece is worn on the user's wrist;

an electronic circuit including at least a timepiece module contained in the main body case;

a first power source contained in the main body case for supplying power to the electronic circuit;

a first connector connected to the first power source;

a separate case having an attachment/detachment structure for detachably mounting the main body case thereto provided at an upper portion;

a second power source contained in the separate case; and a second connector connected to the second power source;

wherein the first connector and the second connector are coupled when the main body case and the separate case are attached, thereby electrically connecting the first power source and the second power source.

4. An electronic timepiece as recited in any one of claims 1 to 3; further comprising attaching portions for attaching the same watch straps to both ends of the main body case and both ends of the separate case.

5. An electronic timepiece according to claim 1; wherein the main function realizing means includes a display unit and the sub-function realizing means outputs data for display on the display unit.

6. An electronic timepiece according to claim 1; wherein the main function realizing means and sub-function realizing means cooperate to provide at least one function.

7. An electronic timepiece according to claim 1; further comprising a first power source disposed in the main body case, and a second power source disposed in the separate case, the first power source being connected to the first connector and the second power source being connected to the second connector so that the first and second power sources are connected to the main function realizing means and the sub-function realizing means when the main body case is mounted to the separate case.

8. An electronic timepiece according to claim 1; further comprising a first power source disposed in the main body case, and a second power source disposed in the separate case, the second power source being connected to the second connector so that the second power source is connected to the main function realizing means and the sub-function realizing means when the main body case is mounted to the separate case.

9. An electronic timepiece according to claim 1; wherein the main body case has attaching portions for attaching a watch strap so that the main body case may be worn on the user's wrist, and the separate case has attaching portions for attaching the watch strap thereto so that the separate case may be worn on the user's wrist.

10. An electronic timepiece according to claim 2; further comprising sub-function realizing means electrically connected to the second connector for performing a function which is not performed by the main function realizing means.

11. An electronic timepiece according to claim 2; wherein the main function realizing means includes a display unit and the sub-function realizing means outputs data for display on the display unit.

12. An electronic timepiece according to claim 1; wherein the main function realizing means and sub-function realizing means cooperate to provide at least one function.

13. An electronic timepiece according to claim 1; wherein the main body case has attaching portions for attaching a watch strap so that the main body case may be worn on the user's wrist, and the separate case has attaching portions for attaching the watch strap thereto so that the separate case may be worn on the user's wrist.

14. A wrist-wearable device comprising: a first case having a wristband mount for mounting a wristband thereto so that the first case may be worn on a user's wrist; a first electrical device contained in the case; a first connector contained in the first case and being connected to the first electrical device and having a contact disposed in the first case; a second case detachably mountable to the first case; a second electrical device contained in the second case; and a second connector contained in the second case and connected to the second electrical device, the second connector having a contact disposed in the second case; wherein the first and second connectors are brought into electrical contact through the contacts thereof when the first and second cases are mounted together.

15. A wrist-wearable device according to claim 14; wherein one of the first and second electrical devices comprises a timepiece movement.

16. A wrist-wearable device according to claim 15; wherein the other one of the first and second electrical devices comprises a data processing circuit.

17. A wrist-wearable device according to claim 15; wherein the other one of the first and second electrical devices comprises a power source.

18. A wrist-wearable device according to claim 14; wherein the first electrical device comprises a timepiece movement, and the first connector is connected to a power source of the timepiece movement.

19. A wrist-wearable device according to claim 18; wherein the second electrical device comprises another power source, so that the power source of the timepiece movement and the other power source are connected when the first and second cases are attached together.

20. A wrist-wearable device according to claim 14; wherein the first electrical device comprises a timepiece movement having a display unit, and the second electrical device comprises a data processing circuit which outputs data for display on the display unit.

21. A wrist-wearable device according to claim 14; wherein the first electrical device and the second electrical device cooperate to perform at least one function.

22. A wrist-wearable device according to claim 14; wherein the second case has a wristband mount for mounting the wristband thereto so that the second case may be worn on a user's wrist with our without the first case attached thereto.

* * * * *

UNITED STATES PATENT AND TRADEMARK OFFICE

CERTIFICATE OF CORRECTION

PATENT NO. : 6,233,203 B1
DATED : May 15, 2001
INVENTOR(S) : Masayuki Kawata

It is certified that error appears in the above-identified patent and that said Letters Patent is hereby corrected as shown below:

Title page,
Item [30], Foreign Application Priority Data, change "July 19, 1998 [JP]" to -- July 9, 1998 [JP] --.

Signed and Sealed this

Thirteenth Day of August, 2002

*Attest:*

*Attesting Officer*

JAMES E. ROGAN
*Director of the United States Patent and Trademark Office*